US006679032B2

(12) United States Patent
Gerrie

(10) Patent No.: US 6,679,032 B2
(45) Date of Patent: Jan. 20, 2004

(54) COMBINED INTEGRAL PICTURE FRAME AND MAILER OR GREETING CARD

(75) Inventor: William Gerrie, Webster, NY (US)

(73) Assignee: Omnifile, Inc., Rochester, NY (US)

( * ) Notice: Subject to any disclaimer, the term of this patent is extended or adjusted under 35 U.S.C. 154(b) by 0 days.

(21) Appl. No.: 10/174,409

(22) Filed: Jun. 18, 2002

(65) Prior Publication Data

US 2002/0157356 A1 Oct. 31, 2002

Related U.S. Application Data

(63) Continuation-in-part of application No. 09/766,745, filed on Jan. 22, 2001.

(51) Int. Cl.[7] ..... A47G 1/14; B65B 11/48
(52) U.S. Cl. ..... 53/460; 40/789
(58) Field of Search ..... 53/460; 229/92.7, 229/92.8, 92.3; 40/774, 775, 776, 788, 789

(56) References Cited

U.S. PATENT DOCUMENTS 4,167,241 A * 9/1979 Zumbrunn ..... 229/92.8
5,314,110 A * 5/1994 Lombardo ..... 229/92.1
5,361,521 A * 11/1994 Burtch ..... 40/750
5,678,756 A * 10/1997 Sugiura ..... 229/313
5,740,957 A * 4/1998 Wenkman ..... 229/92.8
5,950,341 A * 9/1999 Cross ..... 40/750

* cited by examiner

*Primary Examiner*—Steve Gerrity
*Assistant Examiner*—John Paradiso
(74) *Attorney, Agent, or Firm*—Brian B. Shaw, Esq.; Roger Aceto, Esq.; Harter, Secrest & Emery LLP

(57) ABSTRACT

A combined frame and mailer or greeting card are disclosed, either of which is formed from a one-piece blank having a frame front panel, a frame rear panel and a third and fourth panel, each panel being foldably connected to a neighboring panel at a fold line. In the combined frame and mailer, the third and fourth panels are respectively a mailer rear panel and a mailer front panel, which effectively sandwich the frame front panel and frame rear panel therebetween. In the combined frame and greeting card, the third and fourth panels are respectively an easel panel and a greeting panel. The frame rear panel is sandwiched between the frame front panel and the easel panel are and bonded thereto, a picture receiving pocket being formed between the frame front panel and frame rear panel. The greeting panel is detachable.

27 Claims, 11 Drawing Sheets

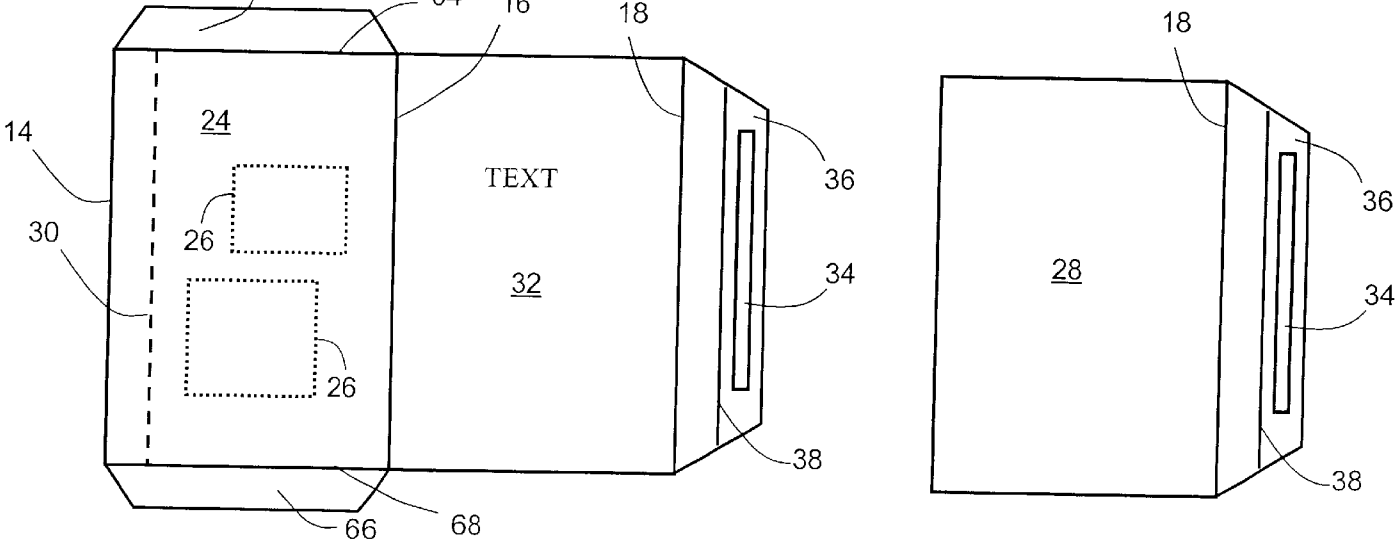
Fig. 11
Fig. 9
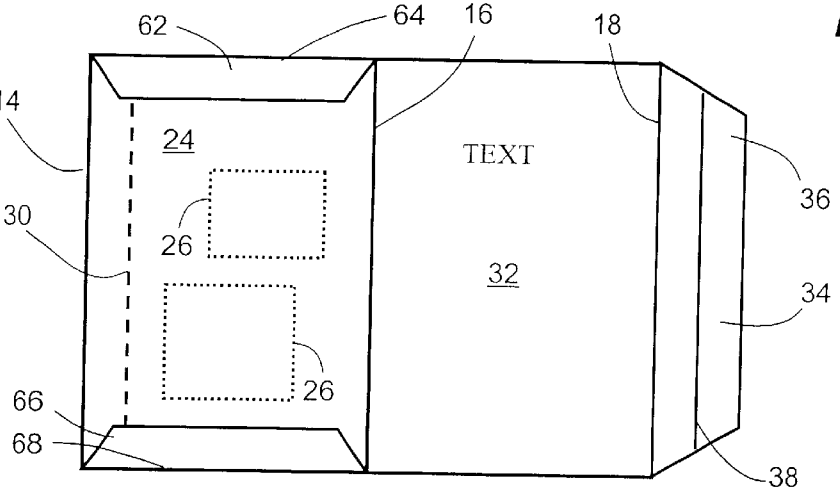
Fig. 10

COMBINED INTEGRAL PICTURE FRAME AND MAILER OR GREETING CARD

RELATED APPLICATION

The present application is a Continuation-in-Part of U.S. Ser. No. 09/766,745, filed Jan. 22, 2001 in the names of William Gerrie and Louis E. Thyroff.

FIELD OF THE INVENTION

The invention is related to a picture frame, and more specifically, to a frame combined with a mailer or greeting card which can withstand shipping and mailing and provide a separable frame having an aesthetically pleasing appearance.

BACKGROUND OF THE INVENTION

People often want to send photographs through the mail, whether it be to family members, friends, or others. However, there are problems with sending photographs through the mail.

Most envelopes are too soft to be used to protect photographs during transit. Unlike letters, a photograph cannot be creased or bent without permanent damage to the photograph.

Alternatively, one may frame the picture before mailing it. While the frame will protect the picture during mailing, it will greatly increase the cost of mailing the photograph.

To alleviate this problem, special envelopes have been developed for mailing pictures such as that disclosed in U.S. Pat. No. 5,740,957 issued Apr. 21, 1998. However, one problem with the frame and mailer disclosed therein is that the easels are exposed during the shipping process. It is possible that they would catch on some other item in the mail and rip or tear away. This could not only cause problems for the end receiver, but could cause problems for the U.S. Post Office. If the easels were to be pulled into an extended position during shipping, the mailer may jam the sorting machinery that the post office uses.

Furthermore, since photographs are often mailed for special occasions such as birthdays, a sender may wish to combine a picture frame with a greeting card.

Therefore, a need exists for a combined picture frame and mailer that can withstand the postal process, and provide an attractive separable frame. The need also exists for a combined picture frame and mailer that reduces complications in the mailing process. It is also desirable to produce a combined picture frame and mailer that is easier to manufacture than current combined picture frame and envelopes. A need further exists for a combined frame and greeting card.

SUMMARY OF THE INVENTION

Generally, the invention provides to a combined frame and mailer. The invention allows a person to insert a photograph or picture into a frame, wherein an integral mailer can be folded and sealed about the frame to preclude unintended separation of the photograph from the frame. The sealed product is then mailed, wherein the recipient can subsequently separate the frame from the mailer without altering a pre-existing frame border.

A preferred embodiment of the present invention includes a blank divided into a series of panels. A first panel forms a frame front. The frame front has a viewing aperture through which a photograph is viewed. A second panel forms a frame rear and is connected to the frame front along a first fold line.

The frame rear can include easels that may be folded outward from the panel. The easels allow the frame to be stood upright when the frame is detached from the mailer. To form the frame, the frame front is folded onto the frame rear and sealed together to form a frame having a picture receiving pocket. Pictures may be inserted through the open edge of the frame.

A third panel forming a mailer rear panel is connected to the frame rear along a second fold line. A fourth panel forming a mailer front panel is foldably connected to the mailer rear panel along a third fold line. A closure flap is foldably connected to the fourth panel along a closure fold line. The closure flap can include an adhesive.

The frame may be folded over to overlay the mailer rear panel. The frame and mailer rear panel may then be folded to overlay the frame rear panel and the mailer front panel, thereby protecting both the front and the rear of the frame.

The blank includes a separation line intermediate the first fold line and the second fold line to be proximal to the second fold line and located so that the mailer can be detached from the frame along the separation line. The separation line is located within the footprint of the periphery of the frame front.

The embodiments of the invention disclosed below not only protect the photograph; they also protect the easels cut into the frame rear. The projected markets for these combined picture frame and envelopes include retail sales to tourists and special order sales to businesses. The tourist consumer could write greeting information on the inside. The corporate client could include promotional information to clients, employees, or others.

In another version, the invention could be a combined frame and greeting card. The first, second, third and fourth panels are respectively a frame front panel with an aperture, a frame rear panel, an easel panel and a greeting panel. The folds go in alternating directions. The panels are configured to overlay in the order frame front panel, frame rear panel, easel panel and greeting panel, and the frame rear panel is bonded to each of its neighboring panels at seal lines. The greeting panel is detachable from the easel panel at a line of separation, to leave behind a frame portion; thus, the frame portion has an aperture at the front and provision for forming an easel at the rear. A picture could be inserted into the frame portion either by a sender or a recipient. The greeting panel could have indicia such a written or pictorial greeting. Optionally the frame rear panel could have further written or pictorial indicia which could be viewed through the aperture prior to a picture being inserted in the frame portion.

BRIEF DESCRIPTION OF THE DRAWINGS

FIG. 9 is a top plan view of the blank of FIG. 8 showing partial enclosure of the frame in the mailer, with the retaining flaps in an unfolded position.

FIG. 10 is a top plan view of the blank of FIG. 9, showing partial enclosure of the frame in the mailer with the retaining flaps overlaying a portion of the frame.

FIG. 11 is a top plan view of the blank of FIG. 10 showing the mailer folded and unsealed.

DETAILED DESCRIPTION OF THE PREFERRED EMBODIMENT

Figure 1:
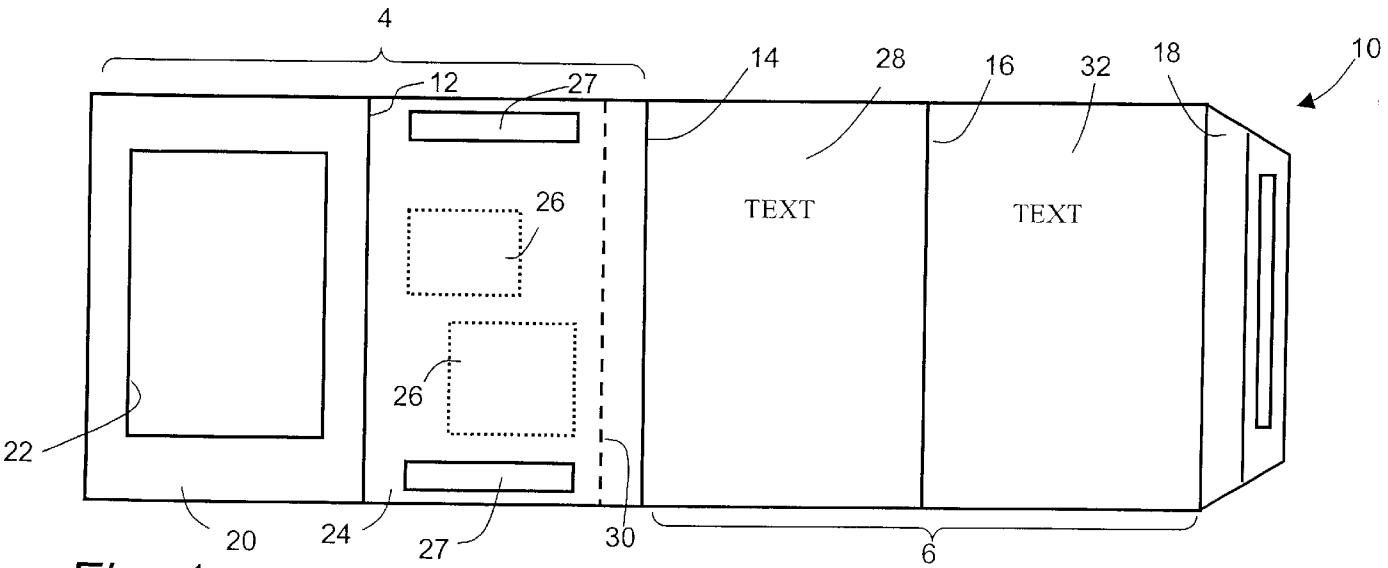
FIG. 1 is a top plan view of a blank for a combined greeting card and mailer.

Referring to FIG. 1, a combined picture frame 4 and mailer 6 is formed from a blank 10. The blank 10 includes a first panel 20, a first fold line 12, a second panel 24, a separation line 30, a second fold line 14, a third panel 28, a third fold line 16, a fourth panel 32, a closure fold line 18 and a closure flap 36. The blank 10 can be formed of a variety of materials including, but not limited to paper board, press board, board, composite, laminates, plastic, or corrugated cardboard.

The fold lines 12, 14, 16 and 18 are located so that the panels can assume an overlapping coplanar configuration. The term fold line refers to lines or creases that allow adjacent panels to fold or bend about an axis lying on the fold line. In a preferred embodiment, the blank 10 is creased so that the fold lines all bend in the same direction.

Figure 2:
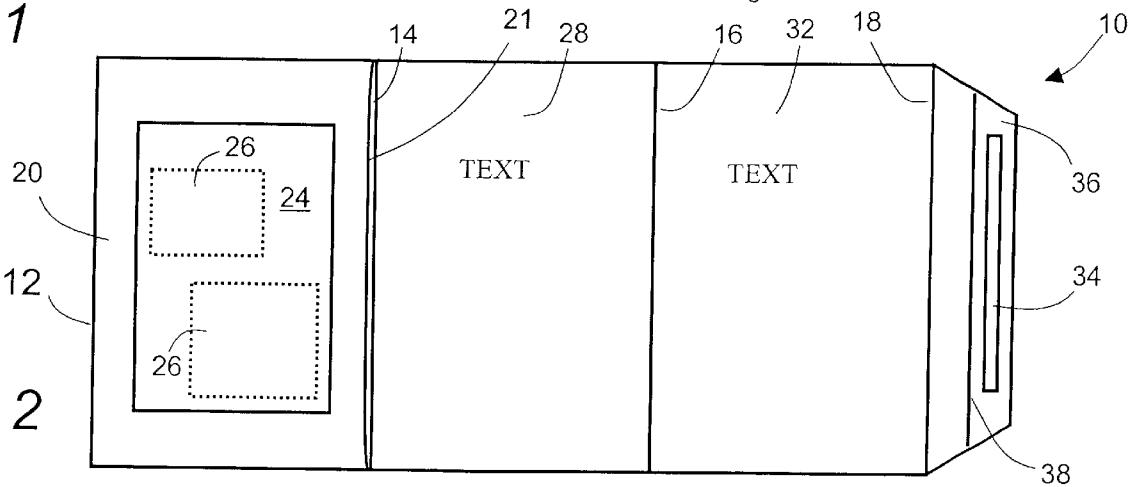
FIG. 2 is a top plan view of the blank showing a frame formed from the blank of FIG. 1.
Figure 5:
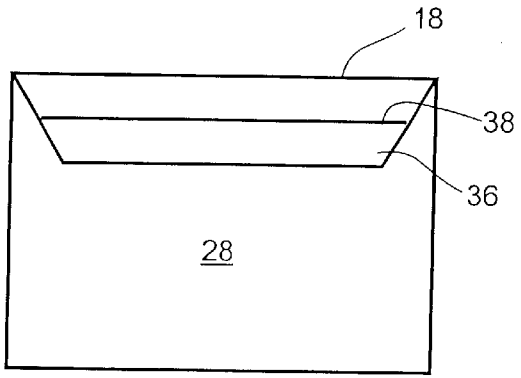
FIG. 5 is a top plan view of the mailer when sealed.

As shown in FIG. 1, a first surface, or side of the blank 10 is shown. Thus, a second surface, or side of the blank 10 is not visible in FIG. 1. Referring to FIG. 2, the second side of the first panel 20 is visible as well as the first side of the third and fourth panels and a portion of the second panel.

The first panel 20 forms the front of the frame and is referred to as frame front panel. An aperture 22 is cut from the frame front panel 20. The aperture 22 provides a window for viewing a photograph placed within the frame 4. A clear plastic or film pane may be placed over the aperture 22, however, the frame 4 can be employed without the pane. The aperture 22 could be any of a variety of shapes. Examples of other shapes include ovals, circles, ellipses and heart-shaped apertures. It is understood the second side of the frame front panel 20 can include a surface finish such as printing, stamping or foil. As described herein, the second side of the frame front panel 20 will form the visible portion of the frame surrounding the retained picture. Thus, an aesthetically pleasing finish can be provided.

The second panel 24 forms the rear of the frame and is referred to as the frame rear panel. The frame rear panel 24 is connected to the frame front panel 20 along the first fold line 12. The frame rear panel 24 includes easel forming cuts and corresponding access apertures. The frame rear panel 24 thus provides for easels 26 to orient the frame in an upright free-standing position.

The frame 4 is formed by folding the frame front panel 20 along the first fold line 12 to overlay the frame rear panel 24. The frame front and frame rear are bonded to each other along seal lines or patches 27. The patches 27 may be formed on the blank 10 to include a removable strip covering an adhesive. The strip can be selectively removed to form the frame. Alternatively, the patch is formed of an adhesive, which is promptly contacted with the remaining panel of the frame 4. Preferably, adhesive strips 27 are located along an upper and lower area of the frame rear panel 24. It is understood these strips may be placed along the upper and lower portions of the frame front panel. Preferably, the strips are applied during the manufacturing process to be parallel to top and bottom edges of the panel. Any particular type of glue or sealant may be used. The sealing along the two adhesive strips 27 combined with the fold line 12 leaves an opening 21 along one edge. A picture may be inserted through the opening 21 after the panels 20 and 24 are bonded together.

Although the periphery of the front frame panel 20 and the rear frame panel 24 are shown as rectangular, the peripheries can have a variety of configurations. For example, the frame front panel 20 could have an oval shape except where part of one side would be flattened out so that it could be creased and folded over onto the frame rear panel 24. Preferably, each panel has a straight edge along the first fold line 12.

The frame rear panel 24 includes a separation line 30 intermediate the first fold line 12 and the second fold line 14, and located proximal to the second fold line. Upon the front frame panel 20 overlaying the rear frame panel 24, the separation line 30 is within the periphery of the front frame panel. The separation line 30 provides a line of weakness in the blank 10, which is weaker than the fold lines. The separation line 30 can be a perforation line where the blank 10 is sufficiently weakened to allow the material to separate easily. The separation line 30 allows the frame 4, including frame front panel and frame rear panel (20,24) to be detached from the mailer 4 (panels 28, 32) after the blank 10 has been folded into a mailable configuration. Upon forming the frame 4, the separation line 30 is located within the footprint of the periphery of the frame front panel 20, so that an edge formed by the separation line 30 is not visible to a viewer of a picture in the frame 4. The separation line 30 does not have to be perforated, but may be any line where the material has been weakened to allow separation of the panels along the separation line 30 prior to any separation along a fold line.

Figure 6:
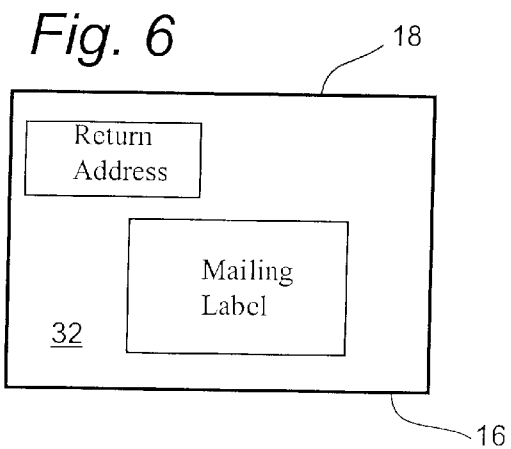
FIG. 6 is a bottom plan view of the mailer when sealed.
Figure 3:
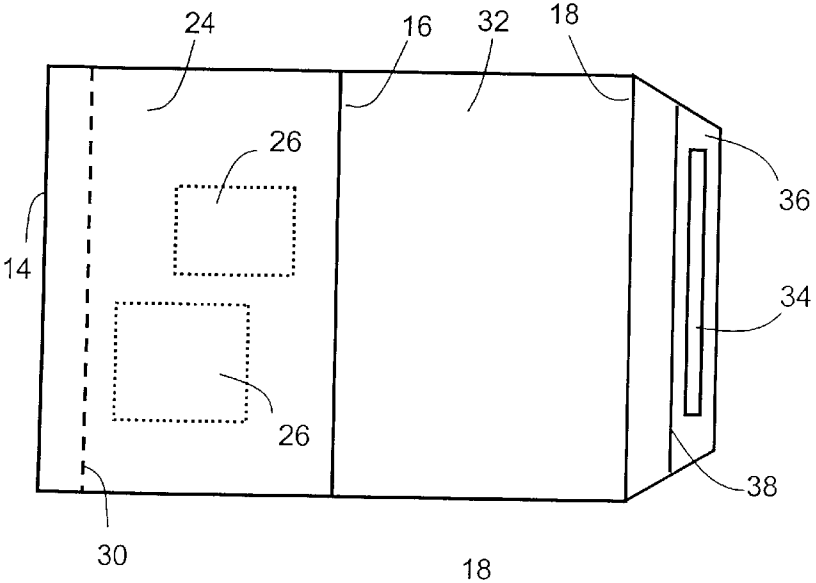
FIG. 3 is a top plan view showing partial enclosure of the frame in the mailer.

The third panel 28 forms a mailer rear panel and is foldably connected to the frame rear panel 24 along the second fold line 14. Preferably, the mailer rear panel 28 is a contiguous uninterrupted panel. That is, the mailer rear panel 28 is free of cuts, perforations or apertures. The fourth panel 32 is a mailer front panel and is connected to the mailer rear panel 28 along the third fold line 16. The first side of both the mailer panels 28, 32 can contain areas for writing or pasting a message or other information. The second side of the front mailer can include a mailing label as seen in FIG. 6.

The closure flap 36 is connected to the mailer front panel 32 along closure fold line 18. An adhesive strip or seal 34 is formed on the closure flap 36 so that the flap will bond to the second side of the mailer rear panel 28 when the mailer is prepared for mailing. The preferred embodiment includes a peel and seal type strip.

The closure flap 36 further includes a zip strip 38 is located between closure fold line 18 and the adhesive strip 34. The zip strip allows the mailer 6 to be unfolded without damaging the retained photograph. Alternatively, the closure flap 36 can include a tear strip, tear line or tear lines for breaking the closure flap. That is, the closure flap 36 is sacrificed to open the sealed mailer.

Figure 7:
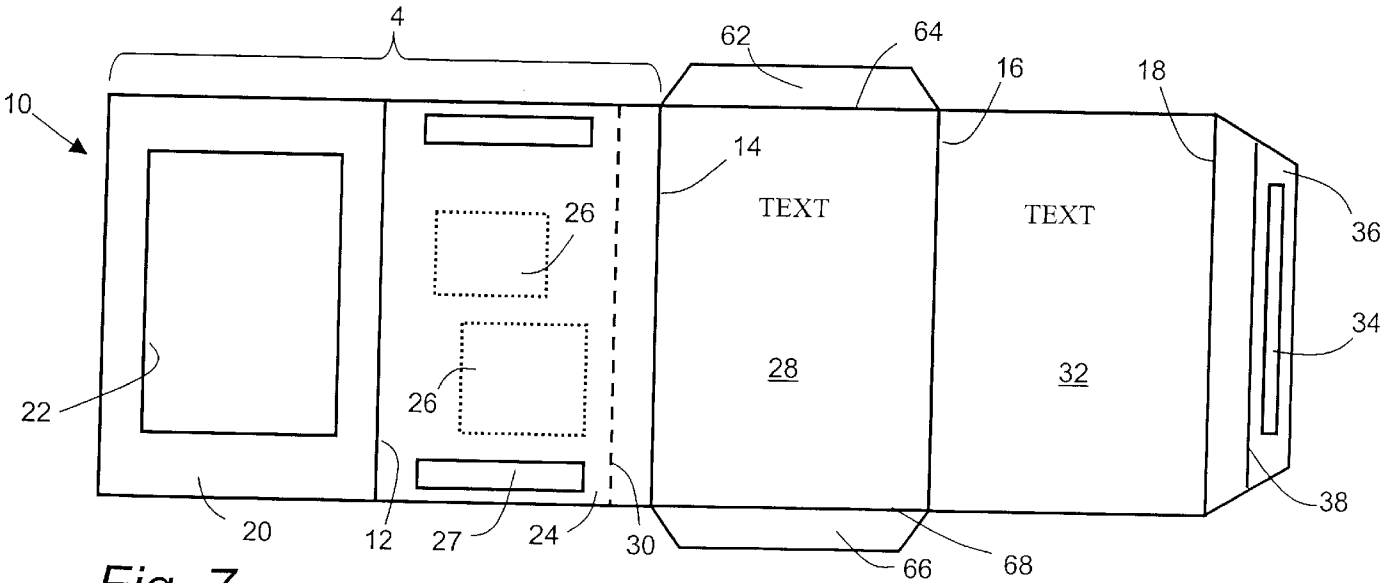
FIG. 7 is a top plan view of an alternative blank having retaining flaps for making the combined greeting card and mailer.
Figure 8:
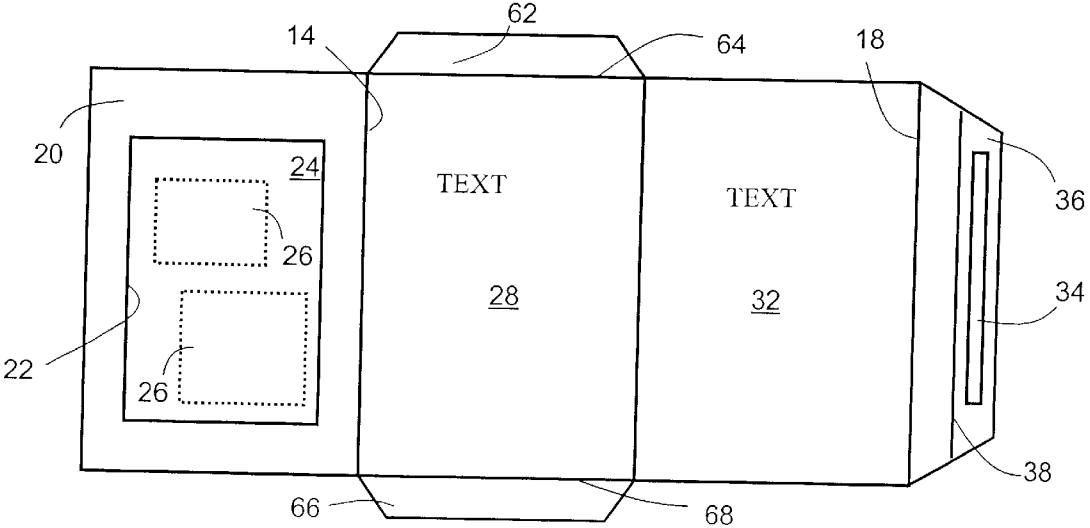
FIG. 8 is a top plan view of the blank of FIG. 7, showing formation of the frame.
Figure 12:
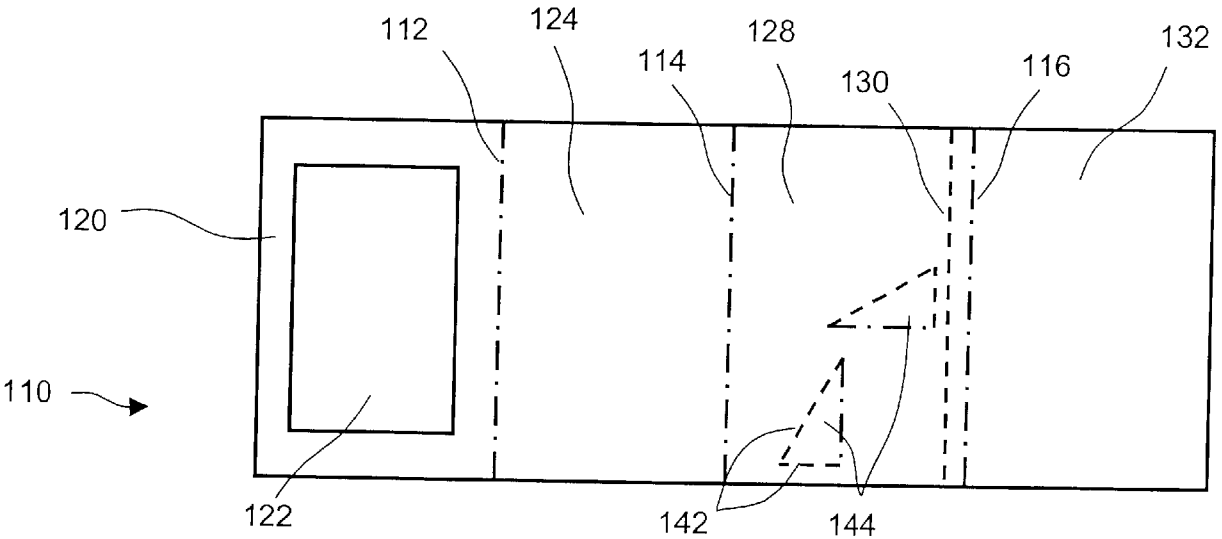
FIG. 12 is a top plan view of a blank in a second embodiment for a combined greeting card and frame.
Figure 13:
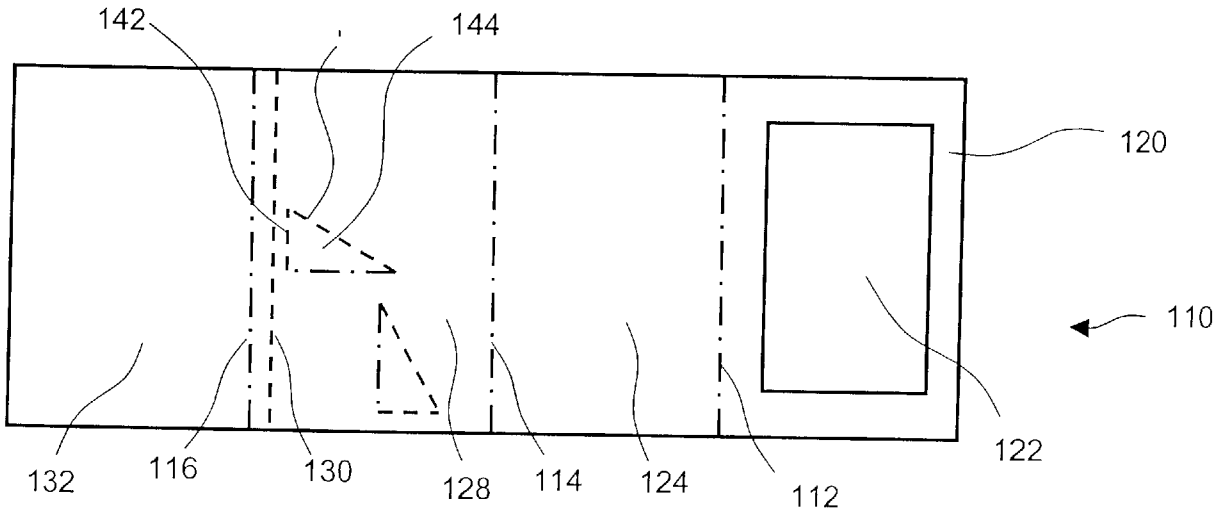
FIG. 13 is a bottom plan view of the blank of FIG. 12.
Figure 14:
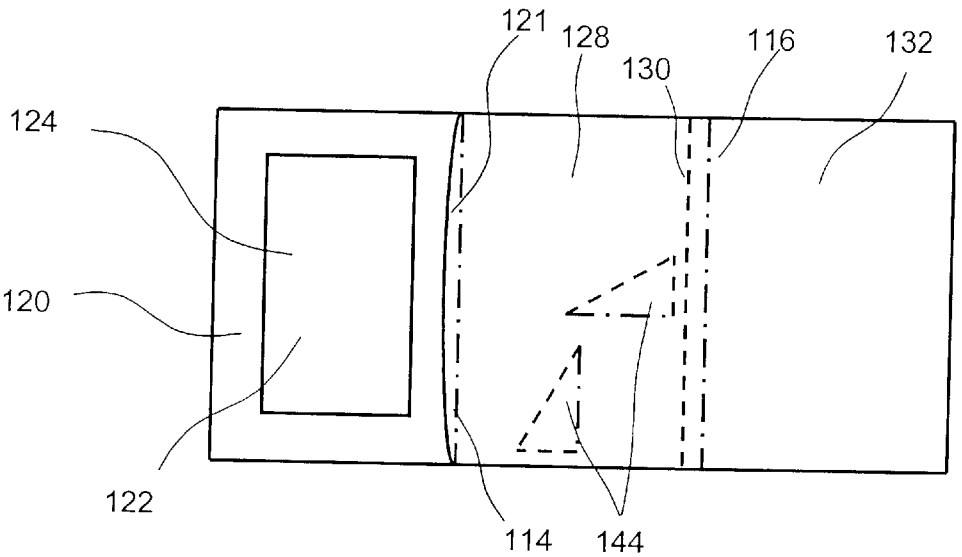
FIG. 14 is a top plan view of the blank of FIG. 12, with a frame front panel folded over a frame rear panel to form a picture receiving pocket.
Figure 15:
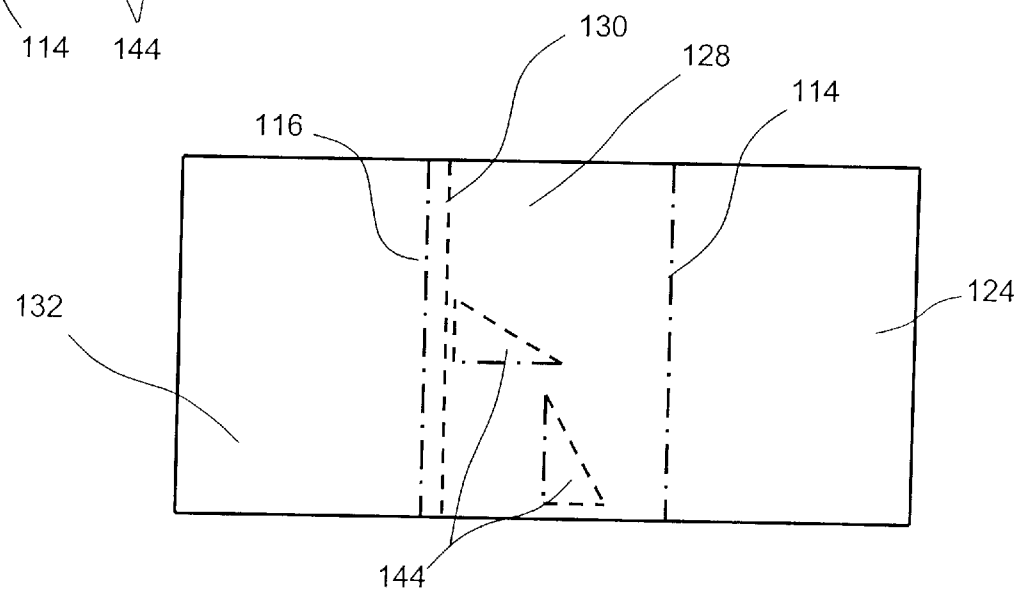
FIG. 15 is a bottom plan view of the blank configured as in FIG. 14.
Figure 16:
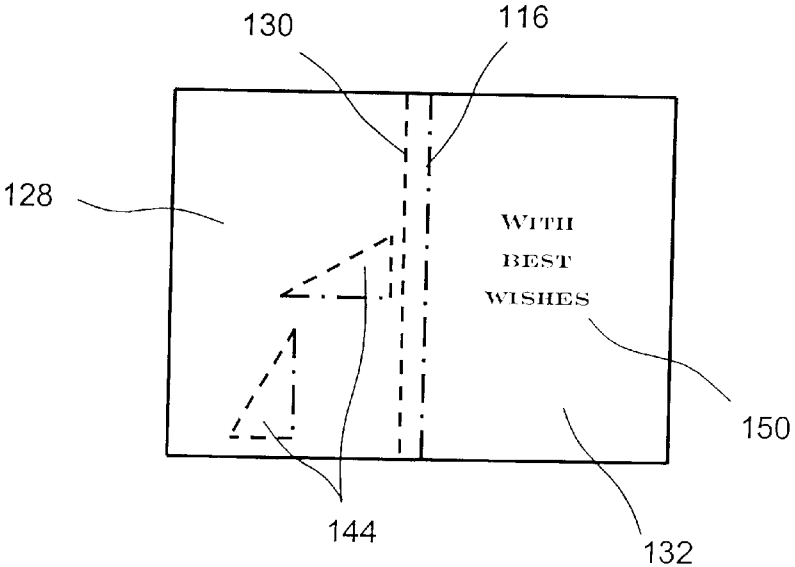
FIG. 16 is the view of FIG. 14, the frame front panel and the frame rear panel having together been folded under an easel panel.
Figure 17:
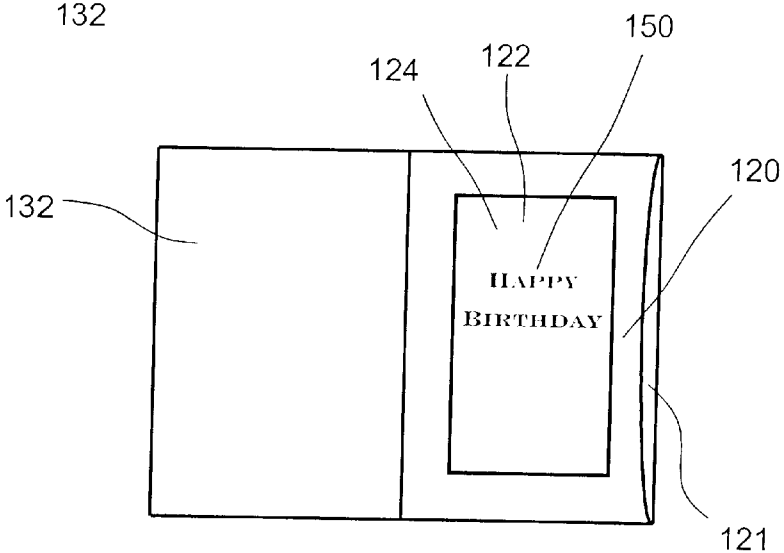
FIG. 17 is the blank as configured in FIG. 16 viewed from beneath.
Figure 18:
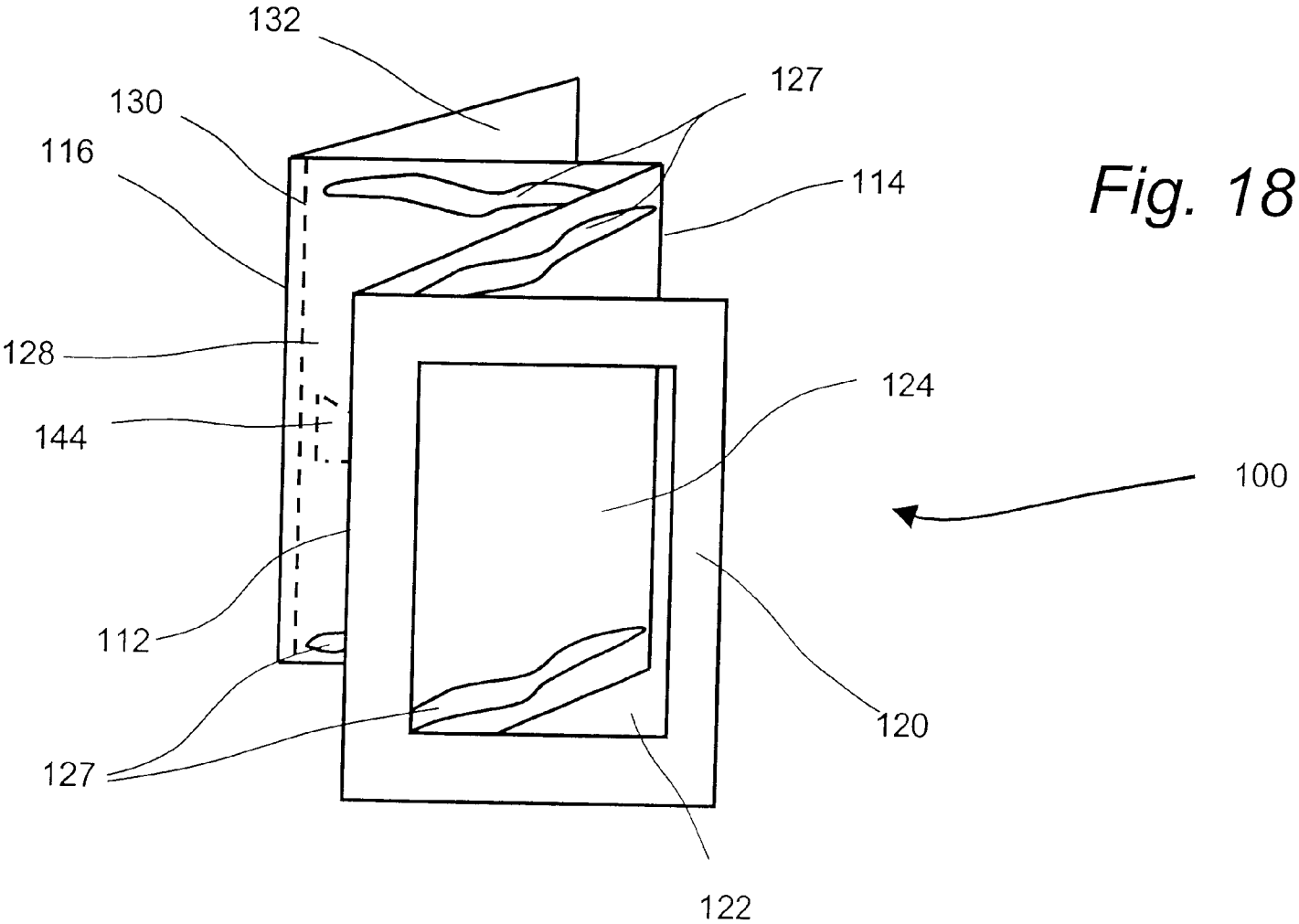
FIG. 18 is a perspective view of the blank of FIG. 12 immediately prior to the frame rear panel being glued to the frame front panel and to the easel panel.

Referring to FIGS. 7–11, the blank 10 can be formed to provide retaining flaps 62, 66. The retaining flaps are preferably integrally formed with the blank 10. The retaining flap 62 is foldably connected to the top edge, as seen in FIG. 7, of the mailer rear panel 28 along fold line 64. The retaining flap 66 is foldably connected to the bottom edge, as seen in FIG. 7, of the mailer rear panel 28 along fold line 68. The fold lines 64 and 68 are formed in the same manner as fold lines 12, 14, 16 and 18. That is, each fold line has a preferred direction of folding. Specifically, referring to FIG. 7 each of the fold lines 12, 14, 16, 18, 64 and 68 prefer folding of either adjacent panel in an upward, out of the plane of the page, direction.

Although the retaining flaps 62, 66 can have any of a variety of configurations and sizes, the flaps are preferably sized to overlay a sufficient area of the frame rear panel 24 to substantially preclude the flap from unfolding upon operable assembly of the mailer.

Preferably, the retaining flaps do not include an adhesive.

Manufacture

Printing, foil stamping, die-cut shapes and embossing can be provided on either side of the panels. In a preferred embodiment the second side of the frame front panel 20 is foil-stamped.

The blank 10 is cut from a sheet of desired material. One method of accomplishing this is by die-cutting. The aperture 22 is also created in the first panel 20. Preferably these methods leave relatively smooth borders that are aesthetically pleasing to the eye. That is, the edges are free of scallops or shards. In addition, the easel cuts and associated apertures can be similarly formed in the frame rear panel 24.

After the blank 10 is completely cut, it may be folded and glued in a single one pass through an assembly line. That is, each of the manufacturing processes are applied to a single side of the blank 10. Thus, the blank 10 can be converted to the configuration of FIGS. 2 through 5 without having the blank flipped or inverted.

Adhesive lines 27 and 34 are applied to the frame rear panel 24. The frame front panel 20 can be automatically folded over onto the frame rear panel 24, where adhesive lines 27, 34 bond the panels together. Typically, the product can be shipped to retail distribution or consumers in this configuration.

To prepare the present invention for mailing, a user inserts a picture into the opening between the front and rear frame panels 20, 24. The frame 4 can then be folded over onto the rear mailer panel 28.

Referring to FIG. 9, the frame 4 has been folded along the fold line 14 to overlay the mailer rear panel 28, with the retaining flaps 62, 66 shown in an unfolded position.

As seen in FIG. 10, the retaining flaps 62, 66 have been folded along the respective fold lines to overlay a portion of the frame rear panel 24. As the retaining flaps 62, 66 are non-adhesive, the retaining flaps are initially retained in the folded position by the corresponding fold line 64, 68.

Figure 4:
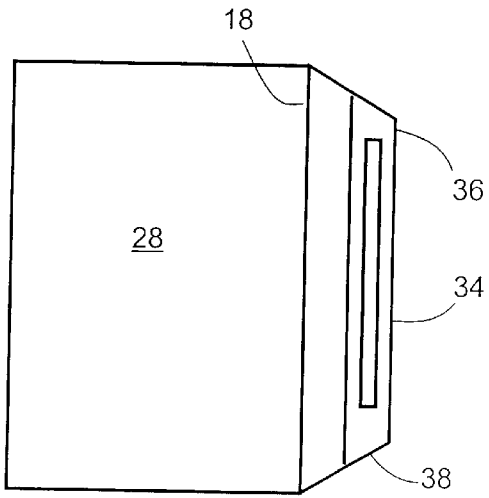
FIG. 4 is a top plan view of the mailer folded and unsealed.

The frame 4 and the mailer rear panel 28 can then be folded over onto the mailer front panel 32 as shown on FIG. 4. The front and the rear frame panels are protected by the mailer front and rear panels. That is, the panels form a stack in the order of mailer front panel 32, frame rear panel 24, frame front panel 20 and the mailer rear panel 28. In the configuration of FIGS. 7–11, the folded configuration provides an order the mailer front panel 32, the retaining flaps 62, 66, the frame rear panel 24, the frame front panel 20, and the mailer rear panel 28. The retaining flaps 62, 66 are sized, and the material of the blank 10 is selected to substantially preclude the retaining flaps from passing from the folded location intermediate frame rear panel 24 and the mailer front panel 32. Finally, the closure flap 36 is folded over and sealed to the second side of the mailer rear panel 28.

The recipient of the mailer can open the mailer by pulling the zip strip 34. The mailer 6 can be unfolded along the second and third fold lines. For the blank of FIGS. 7–11, the retaining flaps 62, 66 are folded along the corresponding fold lines to expose the frame rear panel 24. The recipient can then read or access any material attached to the first side of the mailer front and rear panels 32, 28. The frame 4 is detached from the mailer along the separation line 30, with the newly formed edge being behind, hidden by the frame front panel 20. The easels are formed and the framed picture can be self-supporting on a table or mantel.

The present construction can be used with any relatively thin substrate such as photographs. However, drawings and sketches, invitations, or awards can be employed with the combined frame and mailer.

The combined frame and mailer provides an integral one piece frame and mailer, wherein a photograph can be retained and located within the frame. Text, messages or inserts can be connected to the mailer, and the integral mailer can then be folded and sealed about the frame 4 to protect the front and rear of the frame during the transportation process. As the front and mailer panels have a foot print at least as large as the front frame and rear frame panels, the frame is protected. The sealed device can be readily opened by severing the closure flap without damaging the mailer or the frame. Subsequently, the mailer can be separated from the frame along an effectively hidden separation line.

In a second embodiment, the invention is a combined greeting card and picture frame 100 formed from a blank 110. Referring in particular to FIGS. 12–17, the first and second panels are the frame front panel 120 with the aperture 122, and the frame rear panel 124 joined at a first fold line 112 as before. The frame rear panel 124 can bear indicia 150 such as an illustration, greeting or other marking intended to show through the aperture 122. An easel panel 128 with easel forming cuts 142 is joined to the frame rear panel 124 at a second fold line 114, and a greeting panel 132 is attached to the easel panel 128 at a third fold line 116. The greeting panel 132 bears further information such as a greeting or illustration, and is detachable from the easel panel 128 along a separation line 130. The separation line 130 may coincide with the third fold line 116 but is preferably on the easel panel 128 spaced slightly apart from the third fold line 116 and clear of the easel forming cuts 142.

This greeting card version is intended to be used with an envelope such as a mailing envelope. As best seen in FIG.

18, the blank 110 is folded in alternate directions at the first and second fold lines 112 and 114, thus providing that the frame rear panel 124 is sandwiched between the frame front panel 120 and the easel panel 128, and is bonded to each of the frame front panel 120 and the easel panel 128 at seal lines 127.

Folding in alternate directions is intended to provide that the greeting panel 132 be folded against the easel panel 128, thus hiding the easel cuts 142 and presenting a pleasing appearance to the recipient when it is removed from the envelope. However, it is equally possible to reverse the fold at the third fold line 116, in which case the greeting panel 132 would cover the frame front panel 120 and leave the easel panel 128 exposed.

The frame front panel 120 and the frame rear panel 124 are typically bonded together along opposite edges perpendicular to the first fold line 112, leaving an opening opposed to the first fold line 112. This provides a picture-receiving pocket 121 for inserting a picture 140. With the greeting panel 132 folded over the easel panel 128, the recipient can view any material visible though the aperture 122 on removing the combined greeting card and picture frame 100 from the envelope. Such material could be a picture enclosed by the sender. However, if a picture or other inserted matter were absent, indicia 150 on the frame rear panel, such as a greeting or instructions for use, would be visible through the aperture 122. The recipient could insert a picture of choice whether or not there were a picture from the sender.

Figure 19:
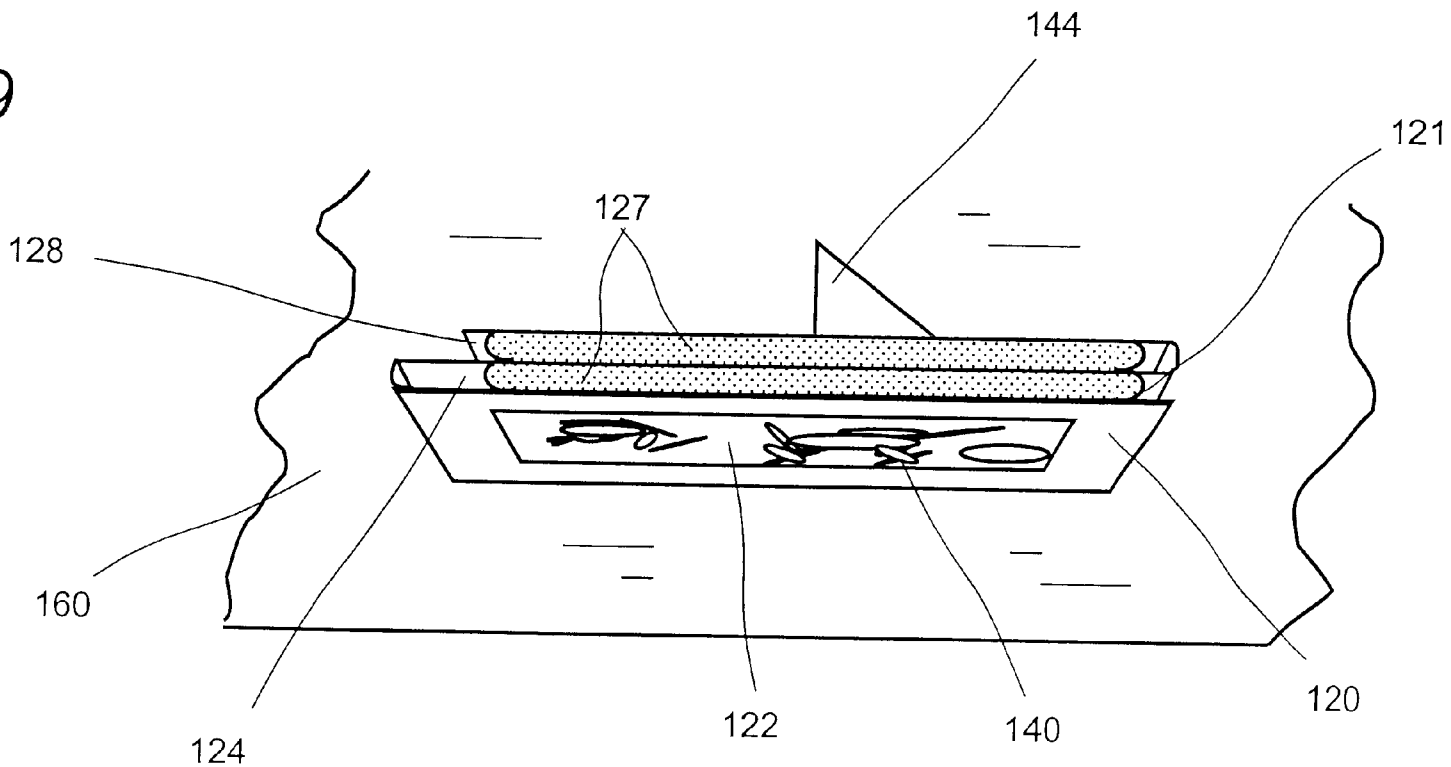
FIG. 19 is a perspective view of a frame portion of the combined greeting card and frame resting on a surface.
Figure 20A:
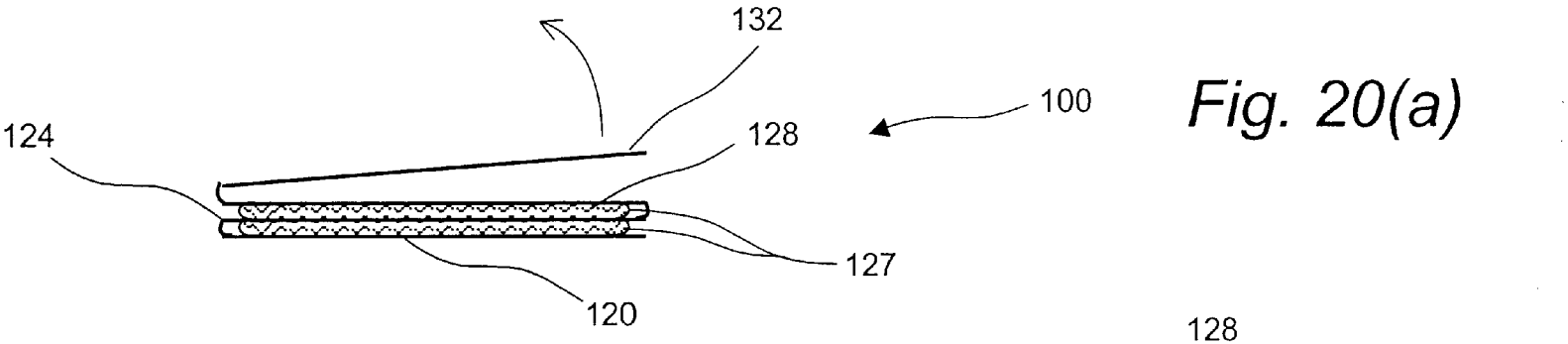
FIGS. 20(*a*), 20(*b*) and 20(*c*) are top edge views of the combined greeting card and frame in various stages of preparation for use.
Figure 20B:
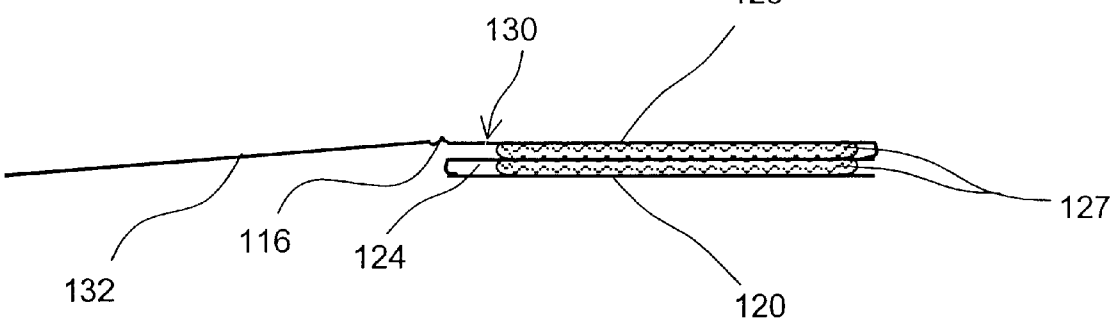
Figure 20C:
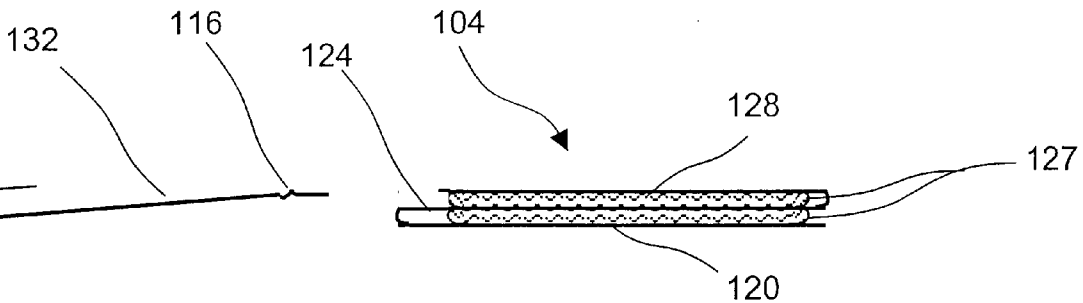
Figure 21A:
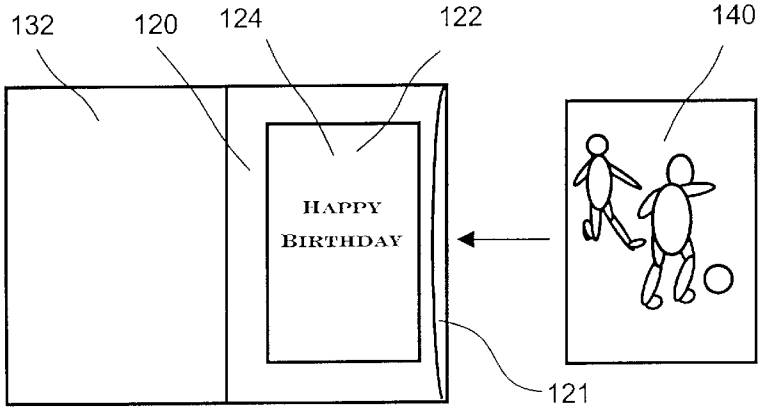
FIGS. 21(*a*), 21(*b*) and 21(*c*) are top views of a picture being inserted into the picture receiving pocket.
Figure 21C:
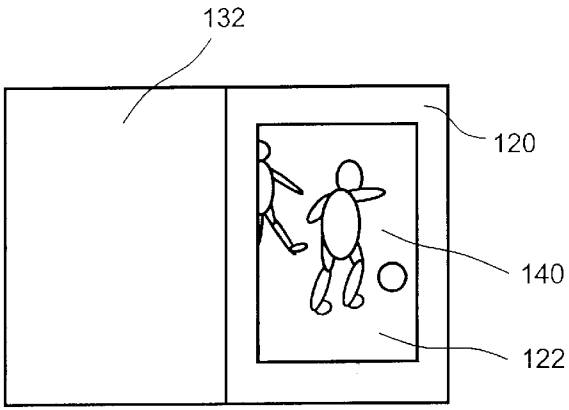
Figure 21B:
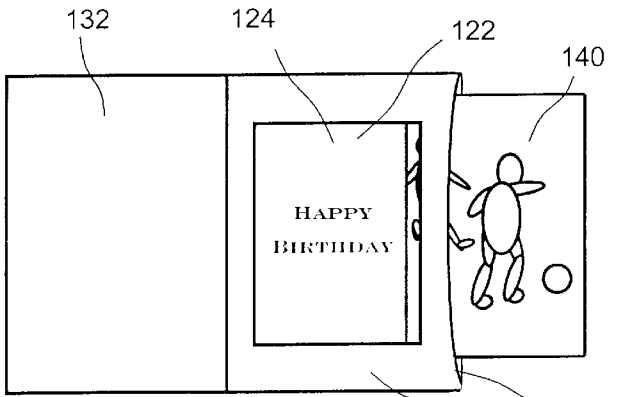

To display the picture 140 on a surface 160 such as a table or shelf, as in FIG. 19, the recipient unfolds the combined greeting card and frame 100 at the fold line 116, and simply detaches the greeting panel 132 from the easel panel 128 at the separation line 130, leaving behind a frame portion 104—see FIGS. 20(*a*)–20(*c*). A picture may already be present in the frame portion 104, or the recipient can insert the picture 140 into the picture receiving pocket 121 as shown in FIGS. 21(*a*)–21(*c*). The recipient then pulls out an easel 144 at the easel forming cuts 142. Note that, regardless of the configuration of the easel 144, one edge of the easel remains foldably attached to the easel frame 128. Two easels 144 are normally provided to allow for displaying a horizontally or vertically oriented picture.

While preferred embodiments of the invention have been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A method of fabricating a greeting card capable of displaying a picture, comprising:

(a) fabricating a blank comprising in order a front frame panel with a picture display aperture, a first fold line, a frame rear panel, a second fold line, an easel panel, a third fold line and a greeting panel;

(b) forming a separation line on the easel panel;

(c) folding the blank at the first fold line so that the frame front panel overlays the frame rear panel;

(d) bonding the frame rear panel to the frame front panel at seal lines to form a picture-receiving pocket;

(e) folding the blank at the second fold line so that the easel panel overlays the frame rear panel; and (f) bonding the easel panel to the frame rear panel.

2. The method of claim 1, further comprising folding the greeting panel to overlay the easel panel.

3. The method of claim 2, further comprising printing indicia on the frame rear panel and on the greeting panel such that the frame rear panel indicia are visible through the aperture and the greeting panel indicia face the easel panel.

4. A combined greeting card and frame, comprising:

(a) a frame front panel having an aperture;

(b) a frame rear panel foldably connected to the frame front panel along a first fold line;

(c) an easel panel foldably connected to the frame rear panel along a second fold line, the easel panel having easel-forming cuts;

(d) a greeting panel foldably connected to the easel panel along a third fold line;

(e) the panels all being substantially the same size.

5. The combined greeting card and frame of claim 1, wherein one of the frame front panel, frame rear panel, easel panel and greeting panel has a separation line.

6. The combined greeting card and frame of claim 5, wherein the separation line is on the easel panel.

7. The combined greeting card and frame of claim 6, wherein the separation line is between the easel cuts and the third fold line.

8. The combined greeting card and frame of claim 5, wherein the separation line coincides with the third fold line.

9. The combined greeting card and frame of claim 4, wherein the frame front panel, the frame rear panel, the first fold line, the easel panel, the second fold line, the greeting panel and the third fold line are constructed to selectively dispose the panels in an over laying configuration having an order of the frame front panel, the frame rear panel, the easel panel and the greeting panel.

10. The combined greeting card and frame of claim 4, wherein the frame rear panel is bonded to each of the frame front panel and the easel panel.

11. The combined greeting card and frame of claim 9, wherein the frame rear panel and the greeting panel have indicia, the frame rear panel indicia being visible through the aperture and the greeting panel indicia facing the easel panel when the greeting panel overlays the easel panel.

12. The combined greeting card and frame of claim 10, wherein the frame rear panel and frame front panel form a picture receiving pocket.

13. A combined greeting card and frame, comprising:

(a) a frame front panel having a picture display aperture;

(b) a frame rear panel foldably connected to the frame front panel along a first fold line, the frame rear panel being adhesively bonded to the frame front panel;

(c) an easel panel foldably connected to the frame rear panel along a second fold line, the easel panel being adhesively bonded to the frame rear panel; and (d) a greeting panel foldably connected to the easel panel along a third fold line.

14. The combined greeting card and frame of claim 13, wherein one of the frame front panel, frame rear panel, easel panel and greeting panel has a separation line.

15. The combined greeting card and frame of claim 8, wherein the separation line is on the easel panel.

16. The combined greeting card and frame of claim 9, wherein the separation line is nearer to the third fold line than to the second fold line.

17. The combined greeting card and frame of claim 9, wherein the separation line coincides with the third fold line.

18. The combined greeting card and frame of claim 13, wherein the easel panel has easel-forming cuts.

19. The combined greeting card and frame of claim 13, wherein the frame front panel, the frame rear panel, the first fold line, the easel panel, the second fold line, the greeting panel and the third fold line are constructed to selectively dispose the panels in an over laying configuration having an order of the frame front panel, the frame rear panel, the easel panel and the greeting panel.

20. The combined greeting card and frame of claim 19, wherein the frame rear panel and the greeting panel have indicia, the frame rear panel indicia being visible through the aperture and the greeting panel indicia facing the easel panel when the greeting panel overlays the easel panel.

21. A blank for forming a combined greeting card and frame, comprising:

(a) a frame front panel having an aperture;

(b) a frame rear panel connected to the frame front panel along a first fold line;

(c) an easel panel connected to the frame rear panel along a second fold line, the easel panel having easel-forming cuts;

(d) a greeting panel connected to the easel panel along a third fold line, the easel panel and the greeting panel symmetrical about the third fold line; and (e) the panels all being substantially the same size.

22. The blank of claim 21, wherein one of the frame front panel, frame rear panel, easel panel and greeting panel has a separation line.

23. The blank of claim 22 wherein the separation line is on the easel panel.

24. The blank of claim 22, wherein the separation line is between the easel cuts and the third fold line.

25. The blank of claim 22, wherein the separation line coincides with the third fold line.

26. The blank of claim 21, wherein the frame rear panel is sized to occlude the aperture in the frame front panel upon folding the frame front panel along the first fold line to overlay the frame rear panel.

27. The blank of claim 21 wherein the frame front panel is adhered to the frame rear panel and a picture receiving pocket is thus formed therebetween.

* * * * *

UNITED STATES PATENT AND TRADEMARK OFFICE

CERTIFICATE OF CORRECTION

PATENT NO. : 6,679,032 B2
DATED : January 20, 2004
INVENTOR(S) : Gerrie, William It is certified that error appears in the above-identified patent and that said Letters Patent is hereby corrected as shown below:

Column 8,
Lines 15-17, reading "The combined greeting card and frame of claim 1, wherein one of the frame front panel, frame rear panel, easel panel and greeting panel has a separation line." should read -- The combined greeting card and frame of claim 4, wherein one of the frame front panel, frame rear panel, easel panel and greeting panel has a separation line. --

Signed and Sealed this

Twenty-seventh Day of April, 2004

JON W. DUDAS
*Acting Director of the United States Patent and Trademark Office*